US006791506B2

(12) United States Patent
Suganthan et al.

(10) Patent No.: US 6,791,506 B2
(45) Date of Patent: Sep. 14, 2004

(54) DUAL BAND SINGLE FEED DIPOLE ANTENNA AND METHOD OF MAKING THE SAME

(75) Inventors: Shanmuganthan Suganthan, Watford (GB); Vladimir Stoiljkovic, Aylesburg (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 1 day.

(21) Appl. No.: 10/278,598

(22) Filed: Oct. 23, 2002

(65) Prior Publication Data

US 2004/0080464 A1 Apr. 29, 2004

(51) Int. Cl.[7] ..... H01Q 9/28

(52) U.S. Cl. ..... 343/795; 343/700 MS

(58) Field of Search ..... 343/793, 795, 343/700 MS, 801, 806, 812, 702, 895, 810, 816, 820, 821

(56) References Cited

U.S. PATENT DOCUMENTS 6,285,342 B1 * 9/2001 Brady et al. ..... 343/795
6,339,405 B1 * 1/2002 Gleener ..... 343/795
6,621,464 B1 * 9/2003 Fang et al. ..... 343/795

* cited by examiner

*Primary Examiner*—Hoang V. Nguyen
(74) *Attorney, Agent, or Firm*—Holland & Hart

(57) ABSTRACT

The present invention provides a dual band single center feed dipole antenna by providing a conventional half-wave dipole antenna single band dipole antenna and loading the single band dipole antenna with two open circuit stubs or arms. The two open circuit stubs form a second half-wave dipole that resonates at a second frequency.

20 Claims, 1 Drawing Sheet

DUAL BAND SINGLE FEED DIPOLE ANTENNA AND METHOD OF MAKING THE SAME

FIELD OF THE INVENTION

The present invention relates to antennas and, more particularly, to dual band single feed printed dipole antennas.

BACKGROUND OF THE INVENTION

Printed antenna structures, also referred to as printed circuit board antenna structures, are widely used to provide compact antennas that can be integrated with other microelectronic devices on a substrate. For example, printed antenna structures may be used with cellular telephones, portable computers, electronic games, personal digital assistants (PDAs), or the like.

One common printed antenna is a monopole antenna (the "Monopole"). The Monopole is a small, omni-directional antenna that can conveniently fit in most electronic devices. However, conventional Monopole antenna rely on the ground plane for successful operation Further, data communications devices have been switching to dual band operation. In particular, there is currently a shift in the requirement from the existing single band operation to dual industrial scientific medical ("ISM") band operation covering, for example, frequency ranges of 2.4–2.5 to 5.15–5.35 GHz. Traditionally, a "trap circuit" was incorporated in the Dipole design to facilitate dual band operation.

Thus, it would be desirous to develop a dual band Dipole that reduced or eliminated the ground plane and/or trap circuit.

SUMMARY OF THE INVENTION

To attain the advantage of and in accordance with the purpose of the present invention, dual band antennas are provided. The dual band antennas include a substrate having a first dipole antenna, have a first ground arm and a first live arm. A second ground arm is connected to the first ground arm, and a second live arm is connected to the first live arm. The second arms form a second dipole antenna.

The present invention also provide a method of marking the dual band antennas. The method includes providing a substrate and selectively metallizing the substrate to form a first half-wave dipole antenna and a second half-wave dipole antenna.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
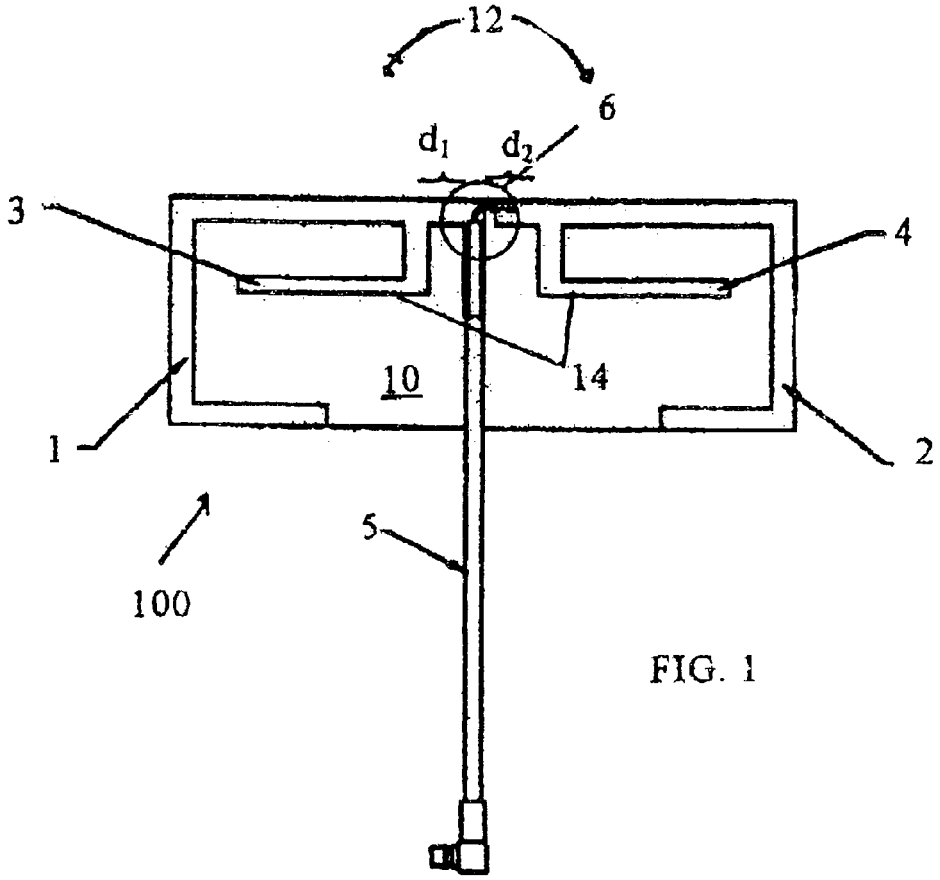
FIG. 1 is a perspective view of an antenna illustrative of the present invention.

Referring to FIG. 1, a dual band single feed dipole antenna 100 illustrative of the present invention is shown.

Dipole antenna 100 includes a substrate 10, a first half-wave dipole 12, and a second half-wave dipole 14. First half-wave dipole 12 contains first ground arm 1 and first live arm 2. Second half-wave dipole 14 contains second ground arm 3 and second live arm 4. A radio frequency power feed 5 connects to a common feed point 6.

First half-wave dipole 12 comprising first ground arm 1 and first live arm 2 operate as a standard center feed half-wave dipole. Second half-wave dipole 14 comprising second ground arm 3 and second live arm 4 also operates as a standard center feed half-wave dipole. While shown as comprising straight traces, arms 1–4 could have alternative configurations, such as meandering or curving, or the like. Also, the arms do not necessarily all need to be the same, for example, arm 1 and arm 2 could be straight, arm 3 and arm 4 could be curved. Normally, the arms are consistent between the half-wave dipoles, but not necessarily. In other words, arm 1 could be straight and arm 2 could be curved. Other combinations are, of course, possible and a straight arm and curved arm are exemplary.

First half-wave dipole 12 generally operates at a lower frequency band than second half-wave dipole 14. First half-wave dipole 12 can have various dimension. As one of ordinary skill in the art would now recognize, the dimensions would be related to the range of frequency operation and the dielectric constant of the substrate.

Second half-wave dipole 14 generally operates at a higher frequency band than first half wave dipole 12. Second half-wave dipole 14 can have various dimension. As one of ordinary skill in the art would now recognize, the dimensions would be related to the range of frequency operation and the dielectric constant of the substrate.

As one of ordinary skill in the art would now recognize, the dual frequency of the operation of the Diople 100 is achieved by loading a conventional half-wave dipole (first half-wave dipole 12) with two open-circuited stubs (second half-wave dipole 14). The length of the stubs or arms 3 and 4 determines the second resonance frequency (or high band frequency). In this case, the stubs are designed for a quarter of the wavelength. Moreover, changing the dielectric constant associated with the substrate 10 influences the resonate frequency of the antenna 100. In has been found a conventional printed circuit board works well for dipole 100, but other substrates can be used.

The impedance for the second half-wave dipole 14 is matched mostly by varying two features of the dipole. First, the placement of arm 3 a distance d, and the placement of arm 4 a distance $d_2$ from the center feed 5, which is normally a coaxial cable feed, a microstrip feed, or the like, can be varied to match the impedance of the second half-wave dipole 14. Second, the widths of the arms 1–4 can be increased or decreased to match the impedance. Of course, as one of skill in the art would recognize, a combination of placement and widths can be used to match impedances. Also, as shown, but not specifically labeled, arms 1–4 can each of various widths at different points to assist with the matching of impedance.

The dual band single feed dipole antenna of the present invention can be manufactured in a number of ways. One possible technique includes two shot molding and selectively plating a substrate. The two shot molding technique uses a first injection mold and a non-platable plastic to form the base substrate 10. The base substrate 10 is placed in a second injection mold and a platable plastic is injection molded on the non-platable plastic Although not specifically shown in FIG. 1, one of ordinary skill in the art would now recognize that the platable plastic is selectively molded on the substrate underneath arms 1–4. The two shot molded piece is then selectively plated to form the arms 1–4 and possible the power feed 5. Although the power feed could be a more conventional solder coaxial cable also. Of course, one of ordinary skill in the art would also recognize that other techniques to make dipole antenna 100 are possible. Other processes could be, for example, using a metal foil that is hot stamped or embossed in on a substrate or the entire substrate is metalized and then certain portions of plating are removed by an etch, such as a laser etch process.

While the invention has been particularly shown and described with reference to an embodiment thereof, it will be understood by those skilled in the art that various other changes in the form and details may be made without departing from the spirit and scope of the invention.

We claim:

1. A dual band antenna, comprising:

a substrate;

a first dipole antenna residing on the substrate;

the first dipole antenna having a first ground arm and a first live arm;

a power feed connected to the first live arm;

a second ground arm connected to the first ground arm;

a second live arm connected to the first live arm;

the second live arm is connected to the power feed through the first live arm; and the second ground arm and the second live arm forming a second dipole.

2. The antenna according to claim 1, wherein:

at least one of the first ground arm, the first live arm, the second ground arm, and second live arm comprises a straight trace.

3. The antenna according to claim 1, wherein:

at least one of the first ground arm, the first live arm, the second ground arm, and second live arm comprises a meander-line trace.

4. The antenna according to claim 1, wherein:

at least one of the first ground arm, the first live arm, the second ground arm, and second live arm comprises a curved trace.

5. The antenna according to claim 1, further comprising:

a wireless device; and the antenna being connected to the wireless device.

6. The antenna according to claim 5, wherein the wireless device comprises at least one of a cellular telephone, an electronic game, a PDA, a television, and a computer.

7. The antenna according to claim 5, wherein the antenna is connected to the wireless device using a cable.

8. The antenna according to claim 5, wherein the antenna is connected to the wireless device using a printed feed line.

9. A dual band antenna, comprising:

a substrate;

means for radiating at a first frequency residing on the substrate, said means for radiating at a first frequency comprising a first dipole;

means for radiating at a second frequency residing on the substrate, said means for radiating at a second frequency comprising a second dipole; and means for providing radio frequency power to the first dipole; and means for connecting the first dipole to the second dipole such that radio frequency power is supplied to the second dipole via the first dipole.

10. The antenna according to claim 9, wherein:

the means for radiating at a first frequency comprises a first ground arm and a first live arm.

11. The antenna according to claim 10, wherein:

the means for radiating at a second frequency comprises a second ground arm and a second live arm.

12. The antenna according to claim 9, wherein:

the means for providing radio frequency power comprises at least one of a cable feed and a microstrip feed.

13. The antenna according to claim 11, wherein the first ground arm, the second ground arm, the first live arm, and the second live arm comprise at least one of a straight trace, a meander-line trace, and a curved line trace.

14. The antenna according to claim 9, further comprising:

a wireless device; and the antenna being connected to the wireless device.

15. The antenna according to claim 14, wherein the wireless device comprises at least one of a cellular telephone, an electronic game, a PDA, a television, and a computer.

16. A method of making a dual band antenna, comprising the steps of:

providing a substrate;

selectively metallizing the substrate to form a first half-wave dipole antenna and a second half-wave dipole antenna, the selectively metallizing step at least comprising providing a metallic connection between the first half-wave dipole antenna and the second half-wave dipole antenna; and connecting a power feed to the first antenna.

17. The method according to claim 16, wherein the substrate is provided by the steps of:

injection molding a first base layer using a non-platable plastic; and injection molding a second base layer using a platable plastic.

18. The method according to claim 16, wherein the substrate is selectively metallized using at least one of an electroless process, an electrolytic process, a hot metal foil stamp process, and a metal embossing process.

19. The method according to claim 17, wherein the substrate is selectively metallized using at least one of an electroless process and an electrolytic process.

20. The method according to claim 16, wherein the substrate is selectively metallized by plating the substrate and etching the plating.

* * * * *